US007387076B2

(12) United States Patent
Bauman et al.

(10) Patent No.: US 7,387,076 B2
(45) Date of Patent: Jun. 17, 2008

(54) LOCKING SYSTEM FOR A DOOR OF AN ENCLOSURE

(75) Inventors: Robert M. Bauman, Severna Park, MD (US); Joseph T. Armfield, Jr., Westminster, MD (US)

(73) Assignee: Merritt Industies, Inc., Taneytown, MD (US)

( * ) Notice: Subject to any disclaimer, the term of this patent is extended or adjusted under 35 U.S.C. 154(b) by 0 days.

(21) Appl. No.: 11/242,484

(22) Filed: Oct. 3, 2005

(65) Prior Publication Data

US 2006/0225628 A1 Oct. 12, 2006

Related U.S. Application Data

(60) Provisional application No. 60/669,366, filed on Apr. 8, 2005.

(51) Int. Cl.
*E05G 1/04* (2006.01)
*E05C 1/00* (2006.01)
*E05C 1/06* (2006.01)

(52) U.S. Cl. ..... 109/59 R; 292/36; 292/32

(58) Field of Classification Search ..... 109/59 R; 292/36, 32, 38, 39, 42
See application file for complete search history.

(56) References Cited

U.S. PATENT DOCUMENTS

| | | | | | |
|---|---|---|---|---|---|
| 131,699 | A | | 9/1872 | Miller | |
| 393,883 | A | * | 12/1888 | Brown | 70/144 |
| 636,325 | A | | 11/1899 | Eyster | |
| 874,833 | A | | 12/1907 | Coon | |
| 1,173,068 | A | | 2/1916 | von Philp | |
| 1,269,572 | A | * | 6/1918 | Allenbaugh | 292/37 |
| 1,366,015 | A | * | 1/1921 | Morris | 70/114 |
| 1,554,700 | A | | 9/1925 | Anderson | |
| 2,460,961 | A | | 2/1949 | Wilson | 292/48 |
| 2,511,268 | A | | 6/1950 | Schiff | 114/117 |
| 3,426,707 | A | * | 2/1969 | Heyl et al. | 109/59 R |
| 4,046,410 | A | | 9/1977 | Connell | 292/36 |
| 4,678,212 | A | | 7/1987 | Rubio | 292/7 |
| 4,728,131 | A | | 3/1988 | Burns | 292/7 |
| 4,754,715 | A | * | 7/1988 | Squires | 109/59 T |
| 5,026,102 | A | * | 6/1991 | Pitman | 292/259 R |
| 5,245,846 | A | * | 9/1993 | James | 70/118 |
| 5,333,920 | A | | 8/1994 | de Rover | 292/48 |
| 5,472,247 | A | * | 12/1995 | Monson | 292/36 |
| 5,778,708 | A | * | 7/1998 | Crosby et al. | 70/118 |
| 6,101,764 | A | | 8/2000 | Guy-Paul | 49/395 |
| 6,319,479 | B1 | | 11/2001 | Houston | 422/292 |

* cited by examiner

*Primary Examiner*—Brian E. Glessner
*Assistant Examiner*—Kristina R. Gluchowski
(74) *Attorney, Agent, or Firm*—Hodes, Pessin, & Katz, P.A.

(57) ABSTRACT

A locking system for a door of an enclosure has a handle, lock, and locking bolts mounted to the door, door jams mounted to the enclosure, dead bolts coupled to the locking bolts, and a blocking bolt coupled to the lock. When door is closed and handle is closed, then locking bolts are moved to locked position, such that door jams block path of locking bolts and thereby prevent door from being opened. When lock is unlocked, dead bolts can move toward each other allowing door to be opened. However, when lock is locked, door cannot be opened because blocking bolt, between dead bolts, prevents dead bolts from moving toward each other.

24 Claims, 13 Drawing Sheets

LOCKING SYSTEM FOR A DOOR OF AN ENCLOSURE

This application is related to provisional patent application Ser. No. 60/669,366 filed Apr. 8, 2005 titled "LOCKING SYSTEM FOR A DOOR OF AN ENCLOSURE".

BACKGROUND OF THE INVENTION

1. Technical Field

The present invention relates to a locking system, and more particularly relates to a locking system used to securely lock a door of an enclosure such as a safe, vault, or other enclosure.

2. Related Art

A safe, vault, or other secure enclosure may be utilized to store items. Locking systems have been developed for such structures, in order to help prevent compromise of the items stored therein.

A variety of systems for locks and doors have been developed, such as, for example: U.S. Pat. No. 131,699 for IMPROVEMENT IN BOLTS FOR SAFES, DOORS, &c. issued to L. H. Miller on Sep. 24, 1872; U.S. Pat. No. 393,883 for SAFE OR VAULT DOOR LOCK issued to W. M. Brown, Jr. on Dec. 4, 1888; U.S. Pat. No. 636,325 for SAFE LOCK issued to C. Eyster on Nov. 7, 1899; U.S. Pat. No. 874,833 for FASTENER FOR REFRIGERATOR DOORS issued to L. G. Coon on Dec. 24, 1907; U.S. Pat. No. 1,173,068 for LOCKING MECHANISM FOR SAFE OR VAULT DOORS issued to H. C. Von Philp on Feb. 22, 1916; and U.S. Pat. No. 1,366,015 for SAFETY LOCK MECHANISM issued to J. Morris on Jan. 18, 1921.

Additional systems for locks and doors have been developed, such as, for example: U.S. Pat. No. 1,554,700 for DOOR LATCH OPERATING DEVICE issued to F. A. Anderson on Sep. 22, 1925; U.S. Pat. No. 2,460,961 for QUICK-ACTING SECURING MEANS FOR WATER-TIGHT DOORS issued to D. G. Wilson on Feb. 8, 1949; U.S. Pat. No. 2,511,268 for BULKHEAD DOOR AND THE LIKE AND FASTENING MEANS FOR SAME issued to Karl L. Schiff on Jun. 13, 1950; U.S. Pat. No. 4,754,715 for TOGGLE-TYPE SAFE DOOR LOCKING MECHANISM issued to William D. Squires on Jul. 5, 1988; U.S. Pat. No. 5,026,102 for MECHANICAL SECURITY DEVICE FOR DOORS issued to James Pitman on Jun. 25, 1991; and U.S. Pat. No. 5,333,920 for PANEL FOR CLOSING AN OPENING, AND CLIP SYSTEM FOR USE AS A PART THEREOF issued to Jan de Rover on Aug. 2, 1994.

Further systems for locks and doors have been developed, such as, for example: U.S. Pat. No. 5,472,247 for MULTI-POINT HIGH SECURITY LOCKING MECHANISM FOR LOTTERY MACHINES issued to Gavin M. Monson on Dec. 5, 1995; U.S. Pat. No. 6,101,764 for PIVOTING DOOR OF THE TYPE HAVING AT LEAST ONE LEAF OF WHICH TWO BARS ARE MOUNTED IN PARALLEL BY MEANS OF LINKS issued to Alix Guy-Paul on Aug. 15, 2000; and U.S. Pat. No. 6,319,479 for CLOSURE FOR A HINGED STERILIZER DOOR issued to John C. Houston on Nov. 20, 2001.

The references listed above may provide a variety of advantages. However, in view of the foregoing, it is believed that there is still a need for a new lock assembly for a door of an enclosure which can provide a more convenient, reliable, and more secure manner of protecting the contents stored in the enclosure, having a simplified operation and a minimum number of moving parts.

Accordingly, further improvements in lock assemblies and systems for doors of enclosures can be envisioned.

SUMMARY OF THE INVENTION

The present invention provides a convenient and elegant lock assembly which allows a door of an enclosure to be securely locked.

In accordance with the principles of the present invention, as embodied and broadly described, the present invention provides a method of securely closing a door over an access opening of an enclosure, the method comprising: closing the door to cover over the access opening of the enclosure; rotating a plurality of locking bolts to a locked position such that the locking bolts are blocked by door jams, the locking bolts being mounted to the door, the door jams being mounted to the enclosure, each of the locking bolts being coupled to a respective dead bolt; when said rotating is performed, moving distal ends of the dead bolts away from each other to form a gap therebetween; and locking a lock mounted to the door; and when said locking of the lock is performed, a blocking bolt coupled to the lock is moved into the gap to prevent the distal ends of the dead bolts from moving back toward each other; wherein when the distal ends of the dead bolts are prevented from moving back toward each other, the door is held securely closed over the access opening.

In accordance with the principles of the present invention, as embodied and broadly described, the present invention provides a locking apparatus, comprising: a lock being mounted to a door which covers an opening of an enclosure; at least one locking bolt being movably mounted to the door, said at least one blocking bolt being movable to a locked position preventing the door from being moved away from the opening of the enclosure, said at least one blocking bolt being movable to an unlocked position allowing the door to be moved away from the opening of the enclosure; at least one dead bolt being coupled to said at least one locking bolt and moving when said at least one locking bolt is moved; and a blocking bolt being mounted to or coupled with said lock (or in communication with said lock), said blocking bolt moving to a locked position blocking a distal end of said at least one dead bolt when said lock is locked, said blocking bolt moving to an unlocked position not blocking the distal end of said at least one dead bolt when said lock is unlocked, wherein when said lock is locked, said blocking bolt prevents forward movement of said at least one dead bolt, said blocking bolt prevents said at least one locking bolt from moving to the unlocked position.

In accordance with the principles of the present invention, as embodied and broadly described, the present invention provides a locking assembly for an enclosure having an access opening, the locking assembly comprising: at least first and second locking bolts mounted to a door which covers the access opening of the enclosure, wherein when the door covers the access opening and said locking bolts are in a locked position, said locking bolts are blocked by door jams mounted to the enclosure; first and second dead bolts being coupled to said locking bolts respectively, said dead bolts being arranged to move toward each other when said locking bolts are moved from the locked position to an unlocked position; a lock being mounted to the door; and a blocking bolt being coupled to said lock and moving in dependence upon said lock, said blocking bolt being between distal ends of said first and second dead bolts when said lock is locked, said blocking bolt moving away from the distal ends of said dead bolts when said lock is unlocked, wherein when said lock is locked, said blocking bolt prevents said first and second dead bolts from moving closer together, prevents said locking bolts from moving to an unlocked position, and prevents the door from being moved away from the access opening.

In accordance with the principles of the present invention, as embodied and broadly described, the present invention provides a locking apparatus, comprising: a plurality of locking bolts being movable between a locked position and an unlocked position, and being mounted to a door which covers over an access opening of an enclosure, said plurality of locking bolts including at least first and second locking bolts; a plurality of door jams blocking said plurality of locking bolts to hold the door in position over the access opening when said plurality of locking bolts are in the locked position, said plurality of door jams being mounted to the enclosure; first and second dead bolts being coupled to said first and second locking bolts respectively, said first and second dead bolts being arranged to move toward each other when said first and second locking bolts are moved from the locked position to the unlocked position; a lock being mounted to the door; and a blocking bolt being coupled to said lock and being movable between a locked position and an unlocked position, said blocking bolt moving in dependence upon said lock, said blocking bolt being disposed between distal ends of said first and second dead bolts when said lock is locked, said blocking bolt being moved away from the distal ends of said first and second dead bolts when said lock is unlocked, wherein when said lock is locked, said blocking bolt prevents said first and second dead bolts from moving closer together, prevents said first and second locking bolts from moving from the locked position to the unlocked position, and prevents the door from being moved away from the access opening.

In accordance with the principles of the present invention, as embodied and broadly described, the present invention provides a locking apparatus, comprising: a lock being mounted to a door which covers an opening of an enclosure; a handle being mounted to the door, said handle being movable between an open position and a closed position; at least one locking bolt being coupled to said handle and being movable in dependence upon movement of said handle, said at least one locking bolt being movable to a locked position when said handle is moved to said closed position, said at least one locking bolt being movable to an unlocked position when said handle is moved to said open position; at least one door jam blocking said at least one locking bolt to hold the door in position over the opening when said at least one locking bolt is in the locked position, said at least one door jam being mounted to the enclosure; at least one dead bolt being coupled to said at least one locking bolt and moving when said at least one locking bolt is moved; and a blocking bolt being coupled with said lock (or in communication with said lock), said blocking bolt moving to a locked position at a distal end of said at least one dead bolt when said lock is locked, said blocking bolt moving to an unlocked position and away from the distal end of said at least one dead bolt when said lock is unlocked, wherein when said lock is locked, said blocking bolt prevents forward movement of said at least one dead bolt, said blocking bolt prevents said at least one locking bolt from moving from the locked position to the unlocked position, said blocking bolt prevents said handle from moving to the open position, and said at least one door jam blocks said at least one locking bolt to hold the door in position over the opening.

In accordance with the principles of the present invention, as embodied and broadly described, the present invention provides an improvement in a secure door for a safe, vault or other security apparatus, wherein the door has a locked and an unlocked position and further has exterior and interior portions, respectively, and wherein a manually-manipulatable lock is mounted on the exterior of the door, the improvement comprising at least one pair of spaced-apart locking bolts pivotably mounted on the interior of the door intermediately of the length of each locking bolt, a door frame provided with respective keepers for the locking bolts, a pair of dead bolts disposed intermediately of the locking bolts and transversely thereof, each dead bolt having a distal end pivotably mounted to a respective locking bolt, a blocking bolt actuatable by the manually-manipulatable lock and normally engaging and preventing the pivoting of the dead bolts in the locked position of the door, such that upon the manual manipulation of the lock, the blocking bolt may be retracted, thereby allowing the dead bolts to pivot, and thereby allowing the locking bolts to pivot and to be released from their respective keepers in the door frame.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PRESENT INVENTION

Figures 1A, 1B:
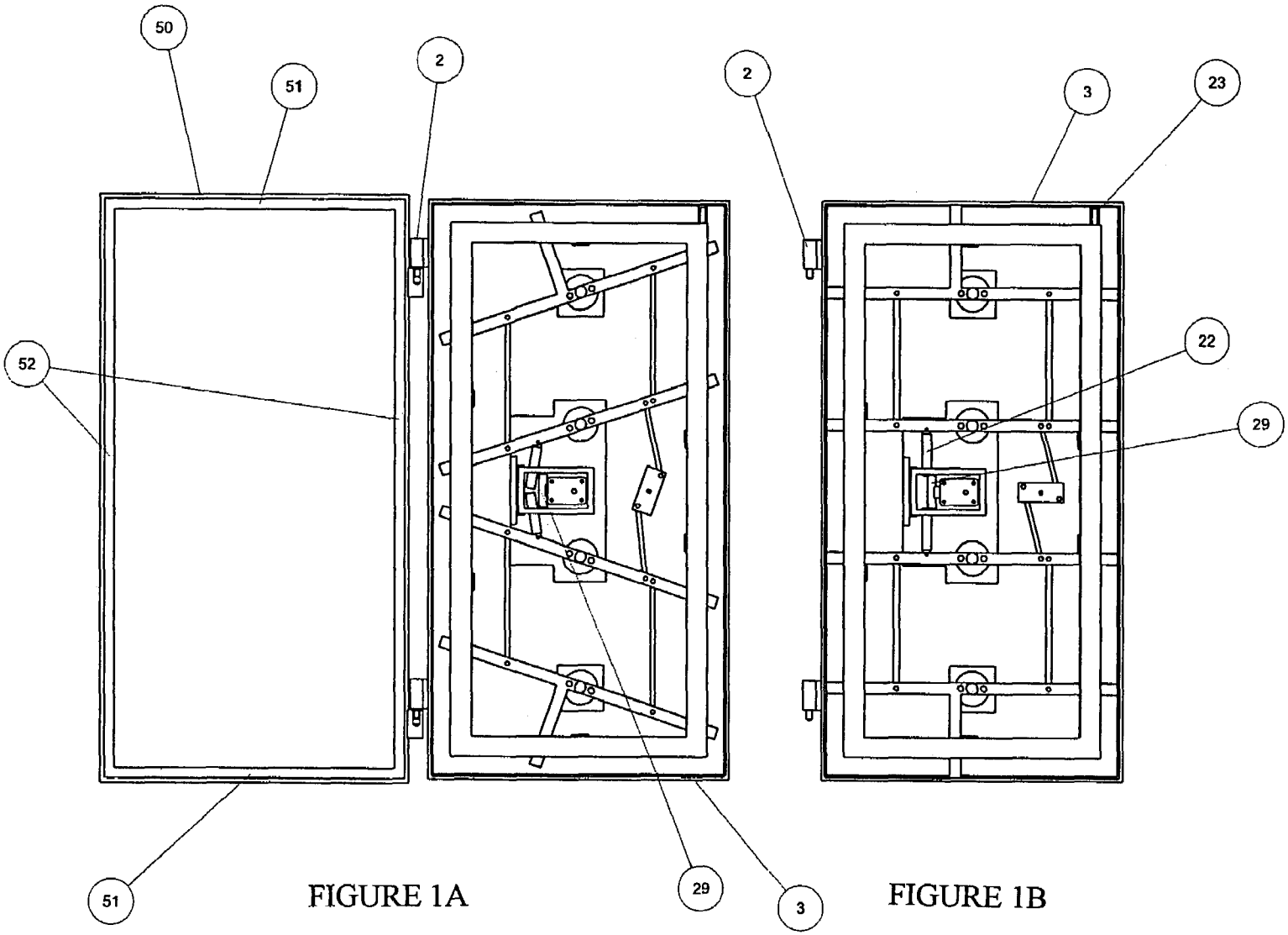
FIG. 1A illustrates a view of a door hinged to an enclosure, wherein a blocking bolt of a lock is in the unlocked position, a handle is in the open position, and the door is in the open position, in accordance with the principles of the present invention.
FIG. 1B illustrates a door, wherein a blocking bolt of a lock is in the locked position and a handle is in the closed position, in accordance with the principles of the present invention.

While the present invention will be described more fully hereinafter with reference to the accompanying drawings, in which details of the present invention are shown, it is to be understood at the outset of the description which follows that persons of skill in the appropriate arts may modify the invention here described while still achieving the favorable results of this invention.

Accordingly, the description of the best mode contemplated of carrying out the invention, which follows, is to be understood as being a broad, teaching disclosure directed to persons of skill in the appropriate arts, and not as limiting upon the present invention.

Illustrative embodiments of the best mode of carrying out the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another.

Moreover, it will be appreciated that such a development effort might be complex and time-consuming, but would nevertheless be a routine undertaking for those of ordinary skill having the benefit of this disclosure.

The present invention provides a new locking system for a door of an enclosure. The locking system can also be referred to as a locking assembly or locking apparatus. According to the principles of the present invention, as broadly described herein, the present invention provides a new door design which includes an improved method of actuation of an improved locking bolt assembly.

Importantly, the present invention utilizes a rotational motion around a pivot point for activating the locking and unlocking process, rather than a push-pull motion. Also, the present invention provides an integrated multiple-point locking bolt at a single pivot point, which is activated by the single rotational motion. Additionally, the present invention utilizes portals as stops resulting in multiple dead bolt points, which is a significant improvement over a use of single point lock bolt dead bolting.

The advantages of the present invention are significant due, in part, to the simplicity of the design such that the linkage has only a minimum of moving parts. Each link can activate multiple locking bolts rotating around the same pivot point in a single motion.

The advantages of the present invention include the following. First, high reliability with a reduced number of wear points and lower force loads leveraged from the use of the rotational movement arm activating multiple locking bolts substantially simultaneously. Second, design flexibility with multiple locking bolt assemblies easily linked together and activated by a single motion to suit any shape or size vault or safe door.

Third, ease of activation with reduced friction induced by the simplified link assembly ensuring smooth, consistent, snag-free operation. Fourth, enhanced protection of the locking assembly by reducing the number and angles of potential compromising access points and concentrated countermeasures. Fifth, reduced cost of manufacturing and maintenance with fewer parts, less to go wrong, enhancing quality control and production repeatability.

The principles of the present invention, relating to the use of the rotational concept, may be applied to any locking mechanism for any type of door.

The locking mechanism of the present invention is designed specifically for a door of an enclosure providing the highest level of protection possible against compromise and unauthorized intrusion. This design is not restricted to only this application of a locking mechanism, but is the implementation chosen as the embodiment to be described herein.

The names and reference symbols listed below correspond to the features depicted in the drawings.

1. Lock Box Assembly (Hardened Lock Box)
2. Hinge Pin Assembly (Hinge)
3. Door Plate (Door)
4. Door Frame, Top
5. Door Frame, Bottom
6. Door Frame, Left
7. Door Frame, Right
8. Plate, Pivot Mount
9. Plate, Lock Box Mount
10. Pivot Stud
11. Pivot Boss
12. Handle Boss
13. Handle Cam
14. Plate, Lock Protector
15. Frame Spacer
16. T-bar, Top (Three Point Locking Bolt)
17. T-bar, Bottom (Three Point Locking Bolt)
18. Center Bar, Top (Two Point Locking Bolt)
19. Center Bar, Bottom (Two Point Locking Bolt)
20. Bar Link (U-Shaped Linkage Pin)
21. Cam Link (U-Shaped Linkage Pin)
22. Arm, Lock Bolt (Dead Bolt)
23. Release, Lock (Bolt Capture/Release Mechanism—interlock)
24. Back Plate, Lock Box
25. Guide, Back Plate
26. Stop, Back Plate
27. Retainer, Back Plate
28. Cover, Door Frame
29. Blocking Bolt (Bolt Extension)
30. Handle, Door
31. Bolt, Handle
32. Label, Handle
33. Screw (Locking Bolt Pivot)
34. Bolt (Interlock)
35. Washer (Interlock)
36. Nut (Interlock)
37. Screw (Door Frame Cover)
38. Screw (Back Plate Retainer)
39. Spring (Interlock)
40. Spring (Tension Spring)
41. Nut
42. Washer
43. Bolt (Dead Bolt)
44. Washer (Dead Bolt)
45. Lock
46. Nut
47. Bolt

Figure 2:
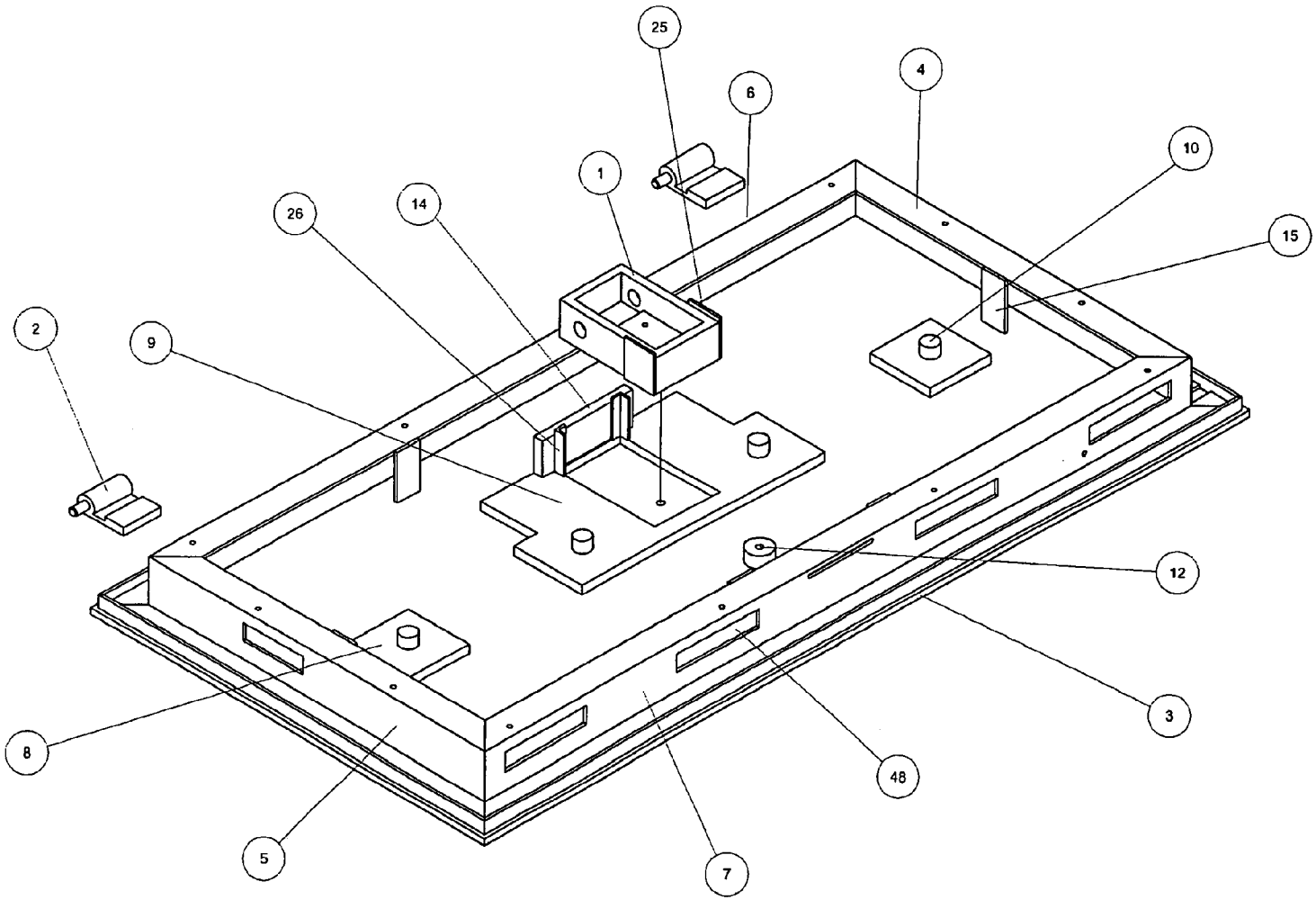
FIG. 2 illustrates a door weldment assembly for a door, in accordance with the principles of the present invention.
Figure 3:
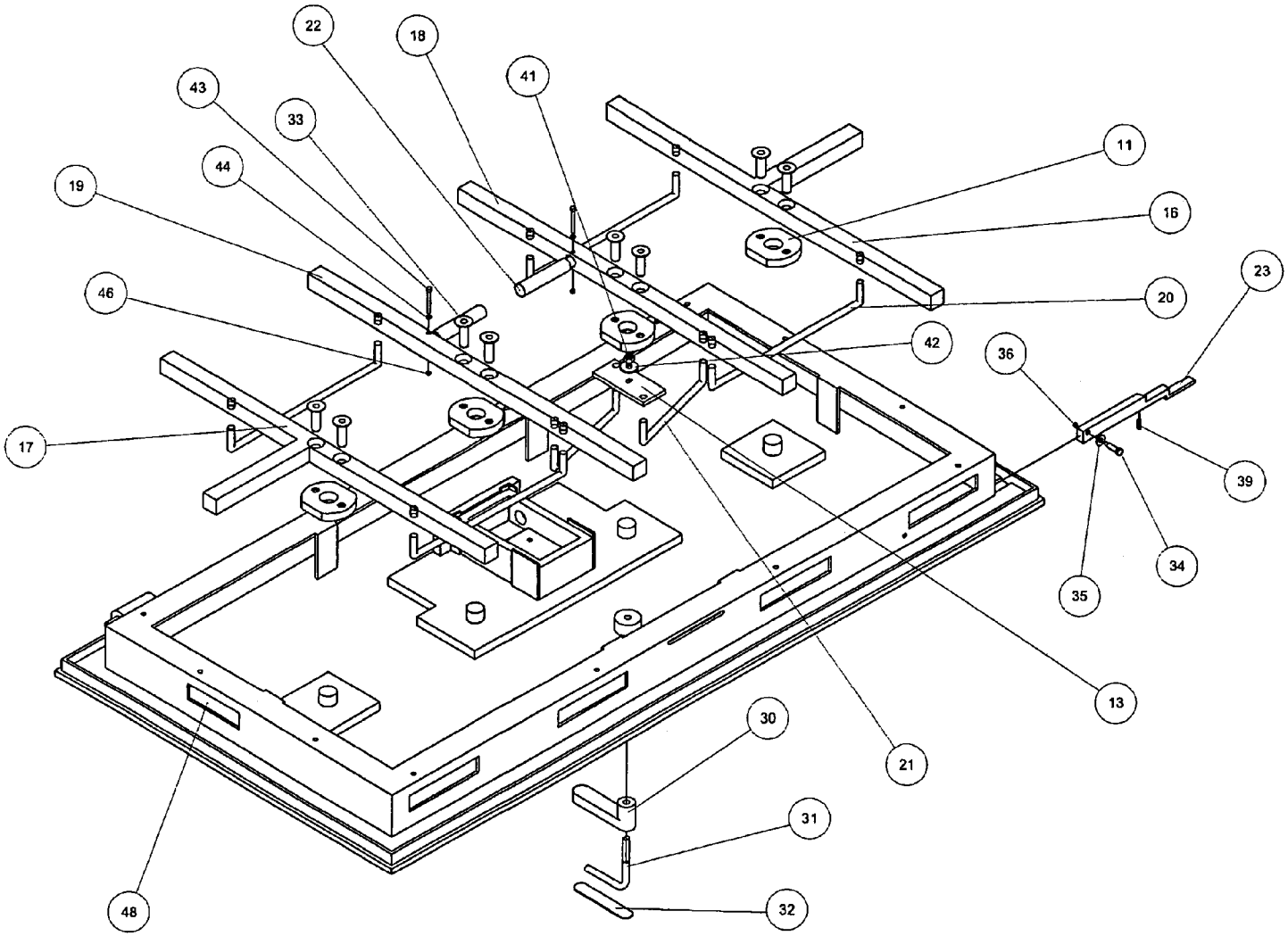
FIG. 3 illustrates a bolt and linkage assembly for a door, in accordance with the principles of the present invention.
Figure 4:
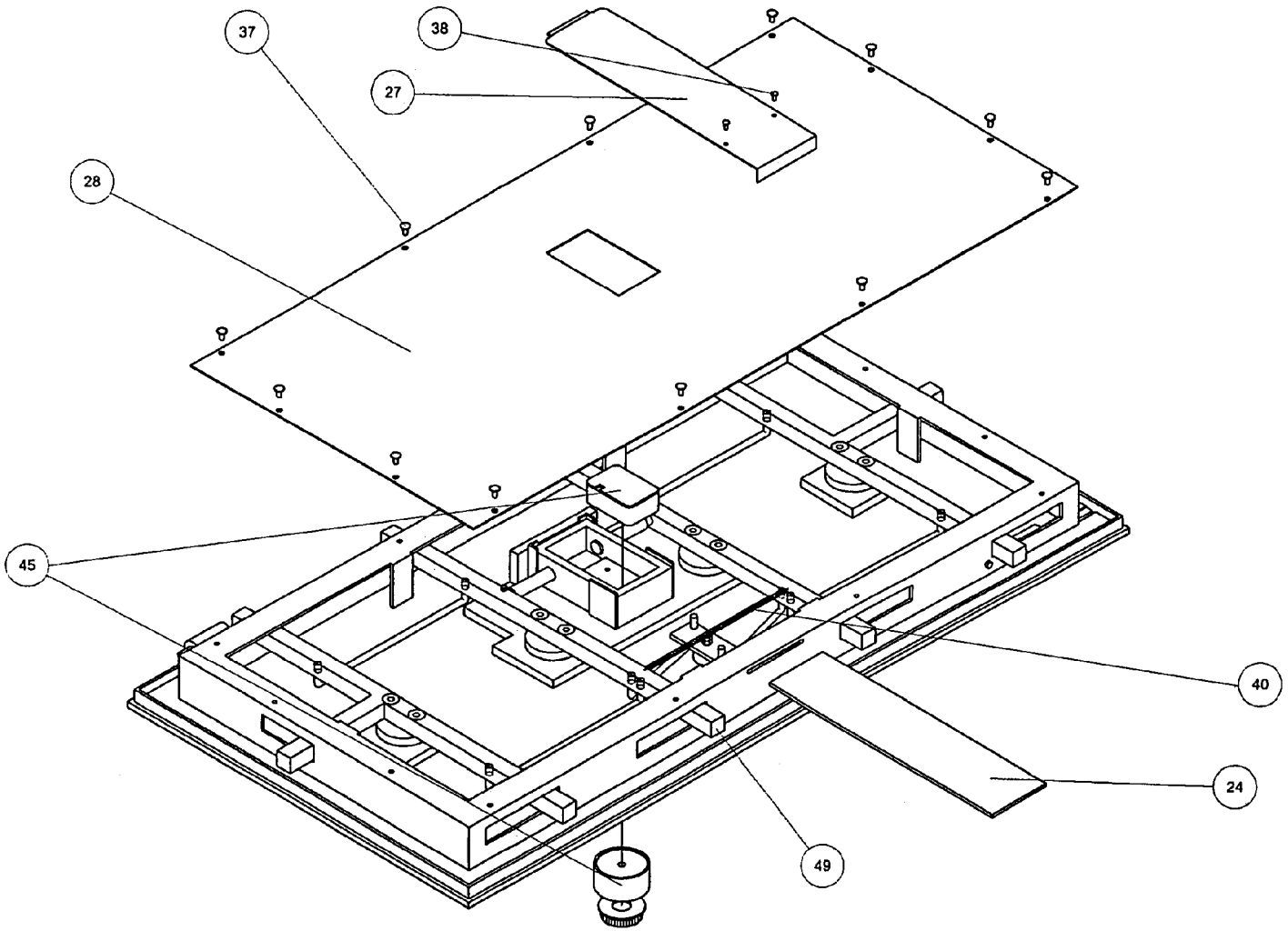
FIG. 4 illustrates a door access/cover plate assembly for a door, in accordance with the principles of the present invention.

48. Portal (Guide)
49. End of Locking Bolt (Tip)
50. Body of Enclosure
51. Door Jam, Top/Bottom
52. Door Jam, Side
53. Plunger FIG. 1A illustrates a view of a door hinged to an enclosure, wherein a blocking bolt of a lock is in the unlocked position, a handle is in the open position, and the door is in the open position, in accordance with the principles of the present invention. FIG. 1B illustrates a door, wherein a blocking bolt of a lock is in the locked position and a handle is in the closed position, in accordance with the principles of the present invention. FIG. 2 illustrates a door weldment assembly for a door, in accordance with the principles of the present invention. FIG. 3 illustrates a bolt and linkage assembly for a door, in accordance with the principles of the present invention. FIG. 4 illustrates a door access/cover plate assembly for a door, in accordance with the principles of the present invention.

According to the principles of the present invention, a door 3 is constructed with a solid hardened steel face on the outside with a hole for the insertion of the lock 45, and a hole for mounting a handle 30 and bolt 31. The lock 45 can be an electro-mechanical combination lock such as that shown in FIG. 4, but is not limited to that type of lock.

The handle 30 and lock 45 are separate mechanisms and may be operated independently. For example, when the lock 45 is unlocked, the handle 30 may be moved from the closed position to the open position and back to the closed position. On the contrary, when the lock 45 is locked, the handle 30 may not be moved from the closed position to the open position.

The inside of the door 3 has a door frame assembly which includes door frame top 4, door frame bottom 5, door frame-left side 6, and door frame-right side 7. The inside of the door and the frame assembly are used for the mounting and protection of the lock assembly, the locking bolts, and the linkage therebetween.

The present invention, as depicted in FIG. 3, includes four locking bolts 16, 17, 18, 19. Locking bolt 16 is also known as top T-bar 16, locking bolt 17 is also known as bottom T-bar 17, locking bolt 18 is also known as top center bar 18, locking bolt 19 is also known as bottom center bar 19.

The door frame assembly is constructed with portals 48 that act as guides controlling the range of motion of the locking bolts 16, 17, 18, 19 in the locked or unlocked positions. The inside door assembly also includes a hardened lock box 1 that, with the lock box mount plate 9, provides additional layered protection for the lock assembly in excess of that provided by the door itself.

The door frame can be mounted to the body of a self-contained safe or the framing of a doorway into a vault or other enclosure. The door frame is constructed to provide a means of capture for the locking bolts 16, 17, 18, 19 in the closed position while providing protection against tampering or compromising the locking bolt integrity itself. The door and doorframe are mated together in a tongue and groove assembly to provide intrusion protection. The door is mounted with two external hinges 2 that control the alignment of the door 3 when closed and the range of motion of the door swing.

The locking bolts 16, 17; 18, 19 are mounted to armored reinforced pivot studs 10 through tapped pivot bosses 11. Each pivot stud 10 is mounted on a pivot mount plate 8. The locking bolts 16, 17, 18, 19 are connected through U-shaped linkage pins 20, 21 to the central rotating handle cam 13. The rotating action of the door handle 30 maneuvers the locking bolts 16, 17, 18, 19 into the locked or unlocked position.

The locking system of the present invention can be configured such that, when the handle 30 is in the closed position, the handle 30 is in a substantially horizontal position. The locking system of the present invention can be configured such that, when the handle 30 is rotated clockwise through an acute angle, the locking bolts 16, 17, 18, 19 are moved from the locked position to the unlocked position.

When the handle 30 is rotated counterclockwise to the horizontal closed position, the dead bolts 22 are separated to allow the movement of the blocking bolt 29 into the locked position by locking the lock 45. This action thereby prevents rotation of the handle 30 and locking bolts 16, 17, 18, 19. In this position, when the door 3 is closed and the lock 45 is locked, the door handle 30 is forced to stay in the horizontal locked position.

To open the door 3 from the locked position, the correct combination must first be entered into the lock 45. The successful unlocking of the lock 45 causes retraction of the blocking bolt 29 from between the dead bolts 22.

Once the blocking bolt 29 is retracted to the unlocked position, the door handle 30 may be rotated clockwise, causing the handle cam 13 to rotate. This action produces simultaneous movement of the linkage and the dead bolts 22 around their respective pivot studs 10 permitting the door 3 to be opened. When fully rotated and moved to the unlocked position, the locking bolts 16, 17, 18, 19 are captured and held in the unlocked position by the bolt capture/release mechanism or interlock 23.

A tension spring 40, connected to the handle cam 13, provides the tension required to return the locking bolts 16, 17, 18, 19 to their locked position after the door 3 has been closed. The action of closing the door 3 forces the interlock 23 to make contact with the door frame pushing it away from its capture position, thus releasing the locking bolts 16, 17, 18, 19 to be rotated into the locked position by the tension spring 40.

Locking the lock 45 extends the blocking bolt 29 into the locked position between the dead bolts 22. In this example, lock 45 is a combination lock. Rotation of the dial on the lock 45 will cause the blocking bolt 29 to extend. The safe, vault, or enclosure is once again returned to the locked state.

FIG. 1A shows the locking bolts 16, 17, 18, 19 in the unlocked position, and shows an arrangement wherein bolt extension 29 of lock 45 is in the unlocked position. FIG. 1B shows the locking bolts 16, 17, 18, 19 in the locked position, and shows an arrangement wherein bolt extension 29 of lock 45 is in the locked position.

The principles of the present invention can be applied to safes, vaults, and other enclosures having a variety of different sizes. Accordingly, it will be easily understood to one of ordinary skill in the related arts that the principles of the present invention are not limited to any particular set of dimensions.

Figure 5:
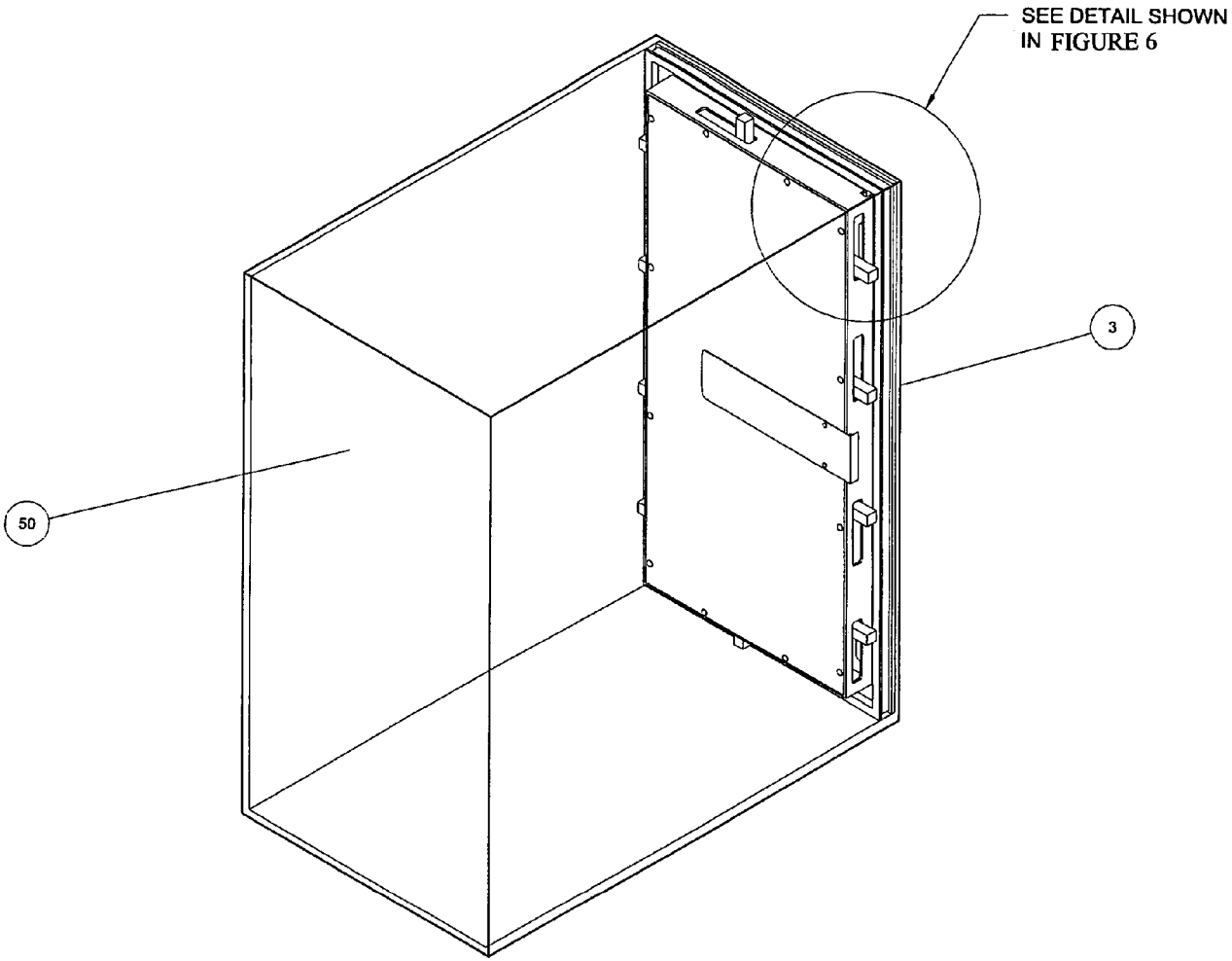
FIG. 5 illustrates a perspective view of a door and an enclosure, wherein a blocking bolt of a lock is in the locked position, a handle is in the closed position, and the door is in the closed position, in accordance with the principles of the present invention.

FIG. 5 illustrates a rear perspective view of a door and an enclosure, wherein a blocking bolt of a lock is in the locked position, a handle is in the closed position, and the door is in the closed position, in accordance with the principles of the present invention. The locking bolts 16, 17, 18, 19 are shown in the locked position. The door 3 is shown in the closed position, securely preventing access to the interior of the body of the enclosure 50. The door 3 is coupled to the enclosure 50 with hinges 2.

Figure 6:
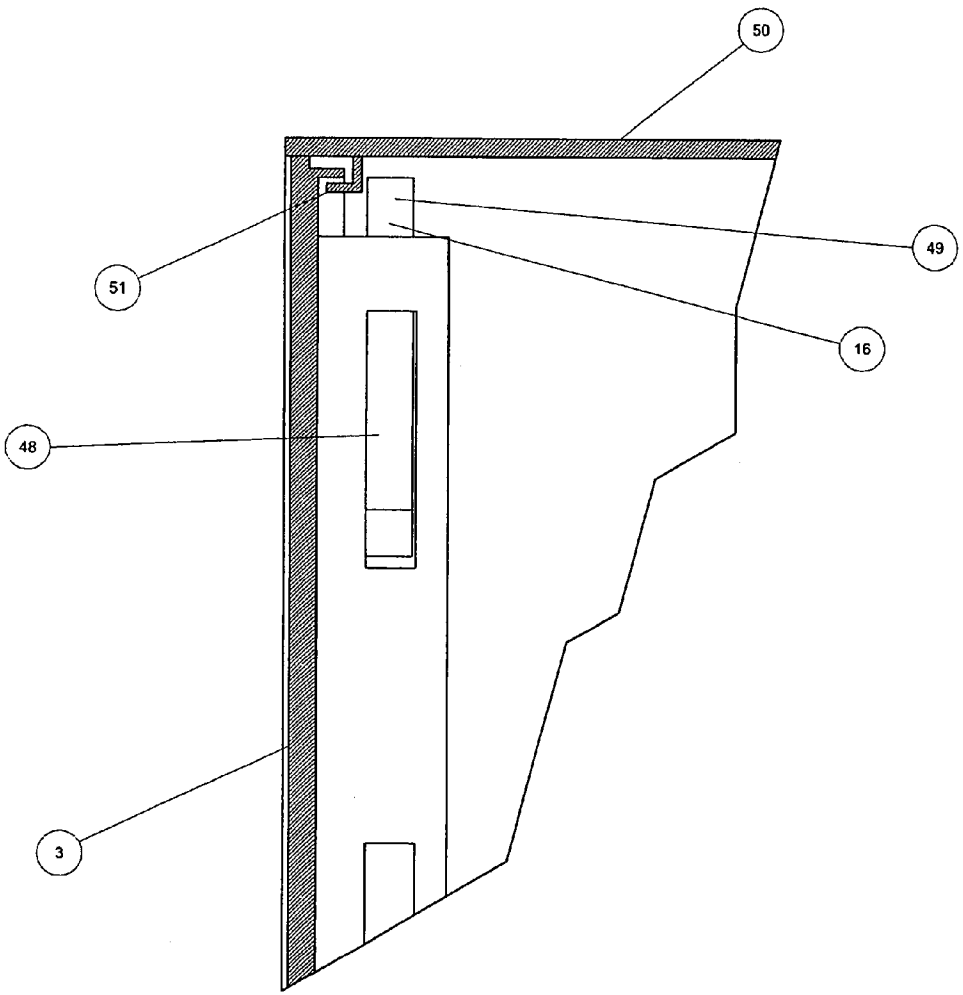
FIG. 6 illustrates a close-up side view of a portion of FIG. 5, relating to lock bolt engagement.

FIG. 6 illustrates a close-up side view of a portion of FIG. 5, relating to locking bolt engagement. Locking bolt 16 is shown in the locked position. FIG. 6 shows a locking bolt end 49 of locking bolt 16 in a position which is adjacent to a door jam 51. The door jam 51 is mounted to the enclosure 50.

With reference to FIGS. 5 and 6, because of the position of door jam 51 and the position of locking bolt end 49, the door 3 cannot be opened. If a person tries to open door 3 when the locking bolt end 49 is positioned in the locked position, as shown in FIGS. 5 and 6, then the door jam 51 will block the path of locking bolt end 49, the portal 48 will hold the locking bolt 16 in position in the door 3, and, in view of the above-described features of the present invention, the door 3 will thus be prevented from being opened. In this manner, the present invention provides a lock assembly for a door of a safe, vault, or other enclosure.

Figure 7:
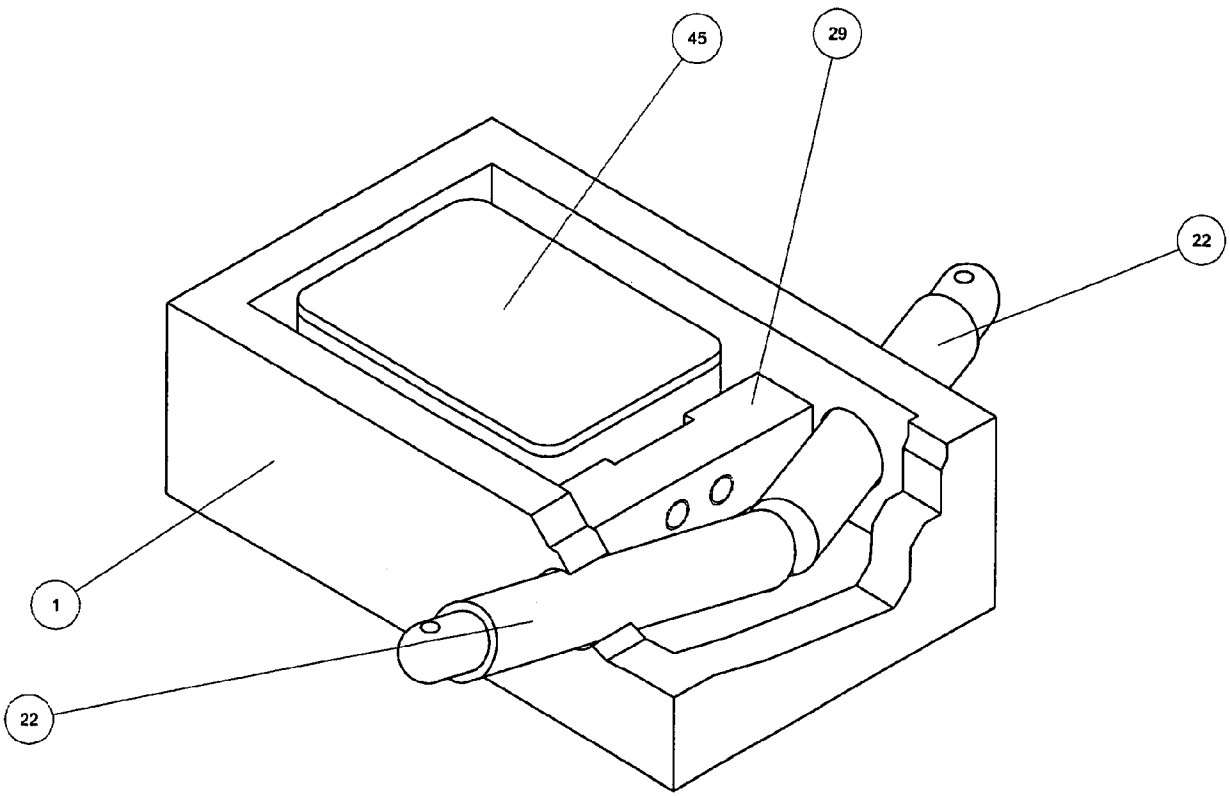
FIG. 7 illustrates a perspective view of a lock box with a blocking bolt of a lock in the unlocked position, in accordance with the principles of the present invention.
Figure 8:
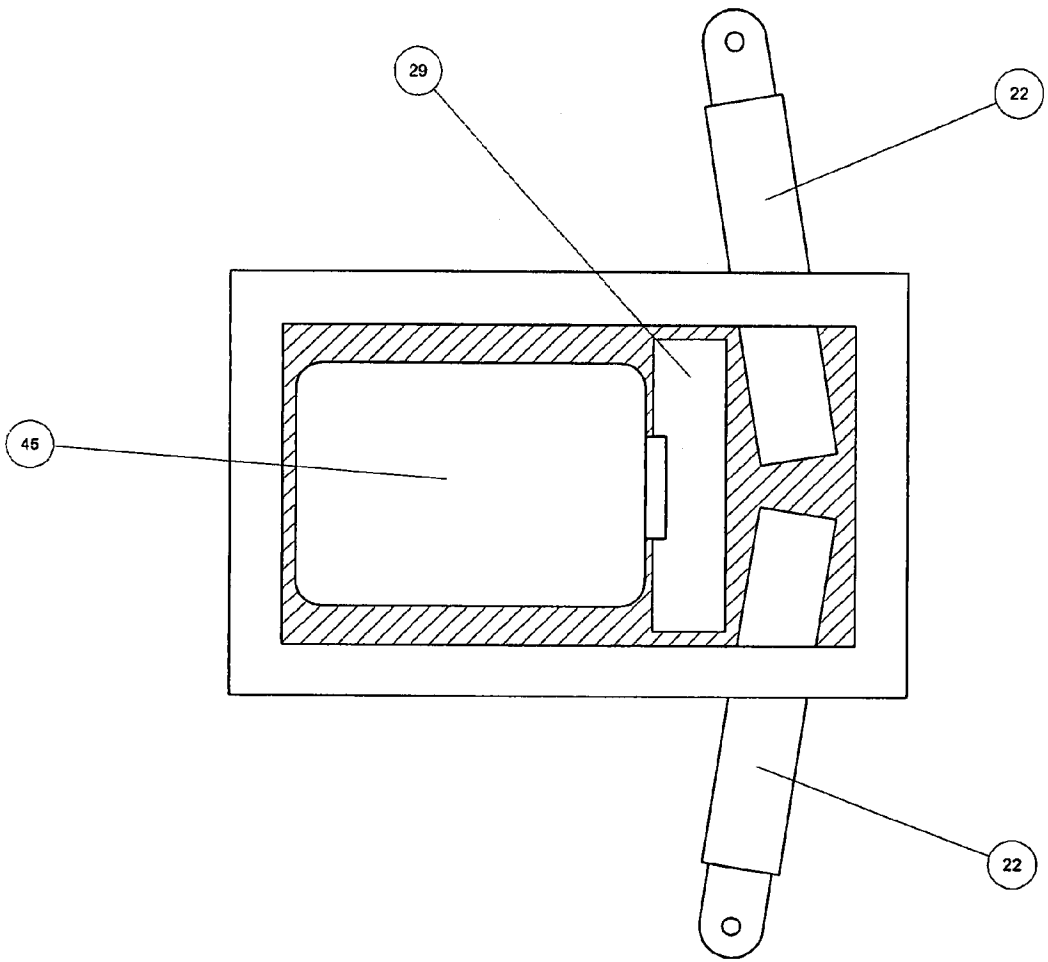
FIG. 8 illustrates a top view of the lock box shown in FIG. 7.

FIG. 7 illustrates a perspective view of a lock box assembly with a blocking bolt of a lock in the unlocked position, in accordance with the principles of the present invention. FIG. 8 illustrates a top view of the lock box assembly shown in FIG. 7. The FIGS. 7 and 8 show that the blocking bolt 29 is in the unlocked position, also known as the retracted position. Thus, the blocking bolt 29 is not disposed between distal ends of dead bolts 22. The dead bolts 22 have been moved so that the distal ends thereof are close together, which means that locking bolts 16, 17, 18, 19 (not shown in FIGS. 7 and 8) would be in the unlocked position.

When dead bolts 22 are positioned as depicted in FIGS. 7 and 8, the locking bolts 16, 17, 18, 19 (not shown in FIGS. 7 and 8) would be in the unlocked position. When the dead bolts 22 are positioned as shown in FIGS. 7 and 8, it would be possible to move the locking bolts 16, 17, 18, 19 from the unlocked position to the locked position and back to the unlocked position, because the lock 45 is not locked. When the lock 45 is not locked, this means that the blocking bolt 29 is not extended outward to the position between distal ends of dead bolts 22.

Figure 9:
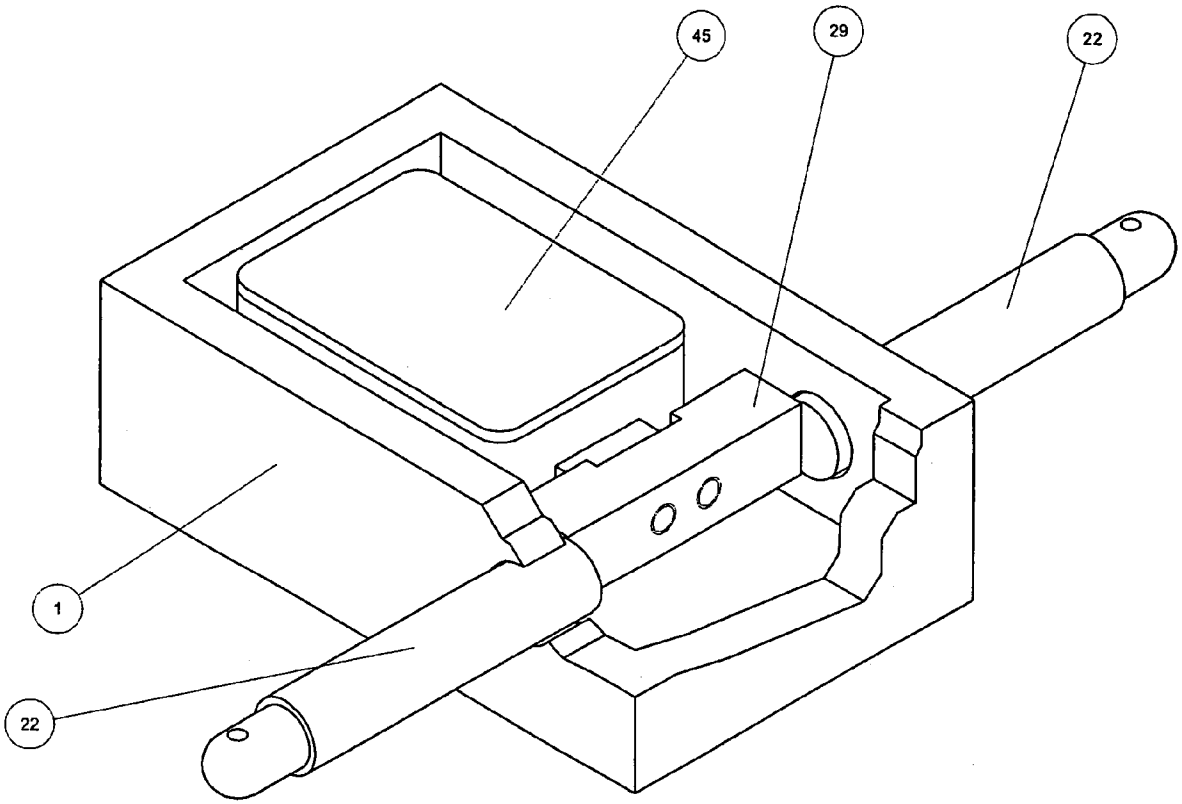
FIG. 9 illustrates a perspective view of a lock box with a blocking bolt of a lock in the locked position, in accordance with the principles of the present invention.
Figure 10:
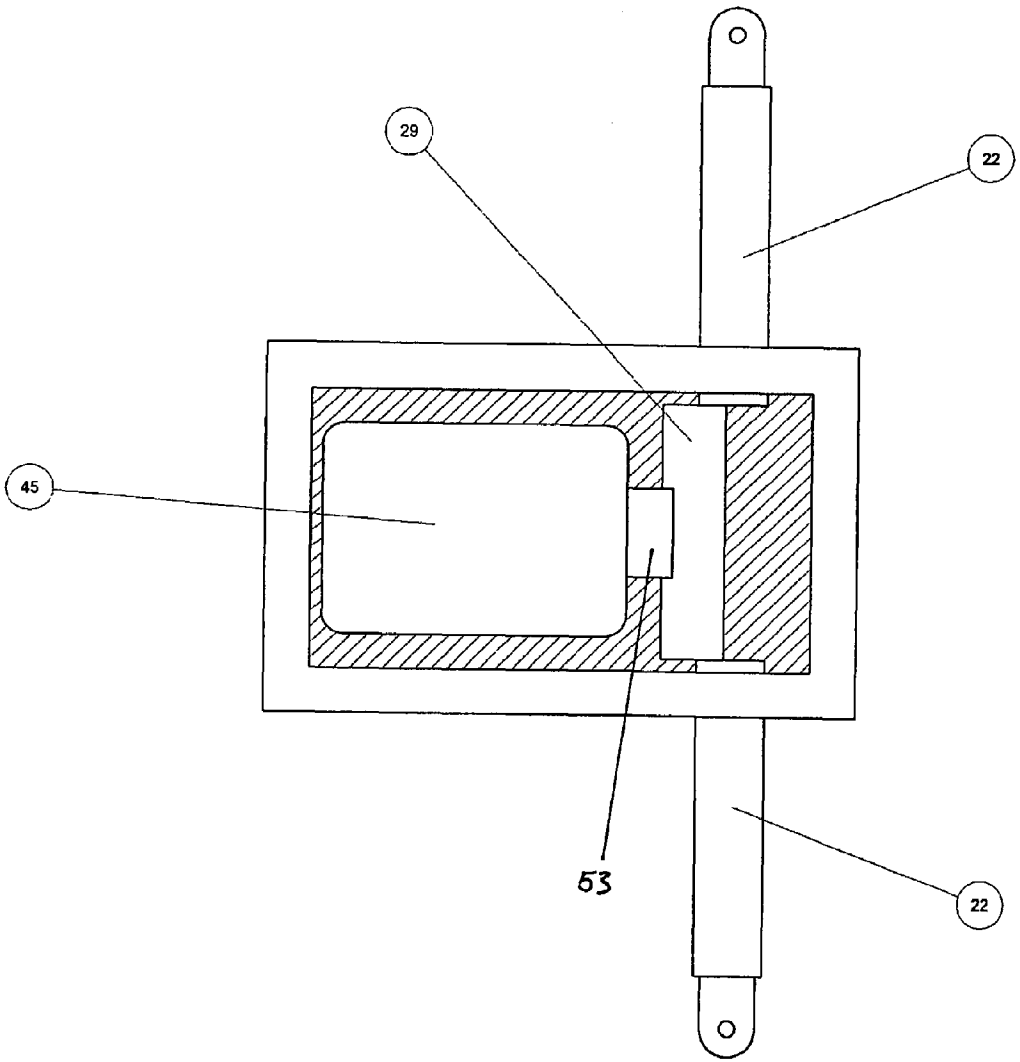
FIG. 10 illustrates a top view of the lock box shown in FIG. 9.

FIG. 9 illustrates a perspective view of a lock box with a blocking bolt of a lock in the locked position, in accordance with the principles of the present invention. FIG. 10 illustrates a top view of the lock box shown in FIG. 9. The FIGS. 9 and 10 show that the blocking bolt 29 is in the locked position, also known as the extended position. Thus, the blocking bolt 29 is disposed between distal ends of dead bolts 22. Here, in FIGS. 9 and 10, the dead bolts 22 have been moved away from each other, so that the distal ends thereof are spaced far apart from each together forming a gap between the distal ends of the dead bolts 22 to allow the extension of the blocking bolt 29 into the gap. This means that locking bolts 16, 17, 18, 19 (not shown in FIGS. 9 and 10) would be in the locked position.

Figure 11:
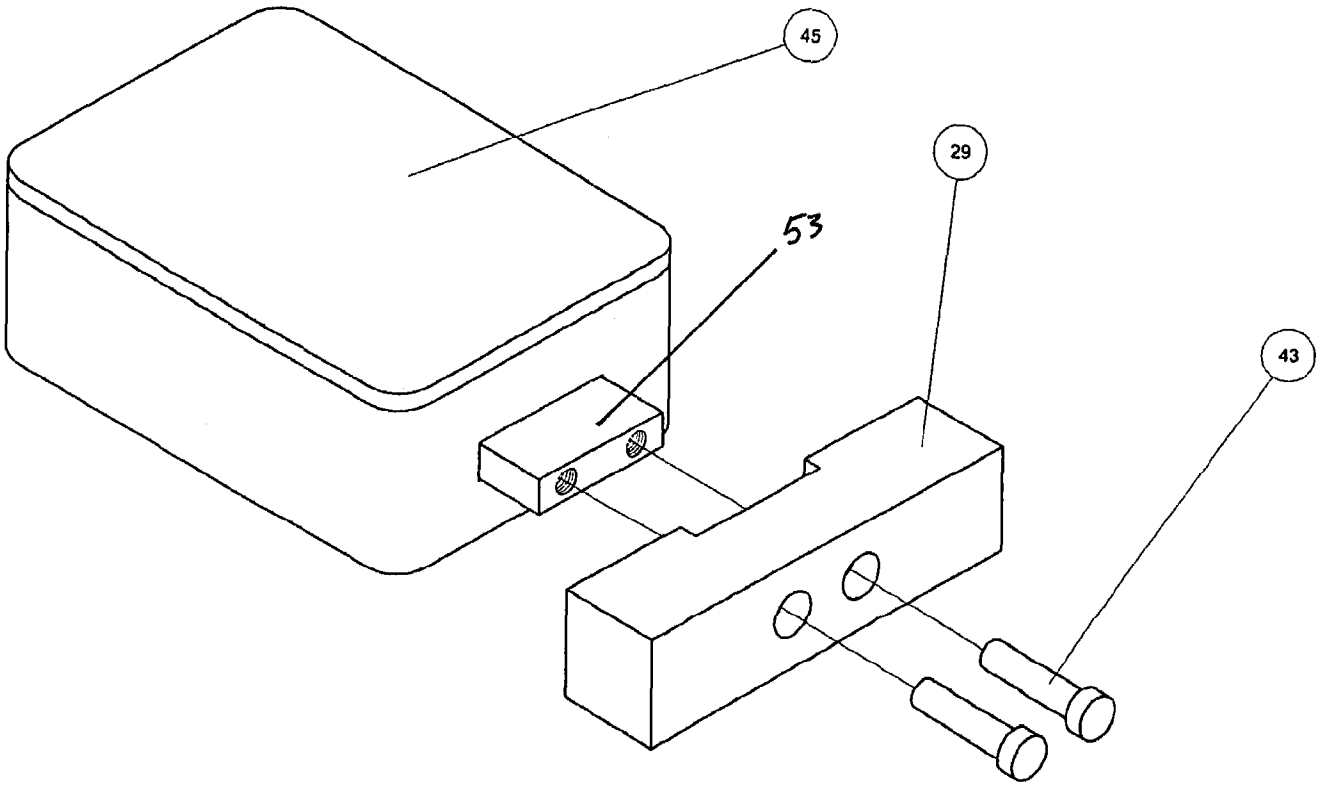
FIG. 11 illustrates a detailed view of a bolt extension assembly of a lock box, in accordance with the principles of the present invention.
Figure 12:
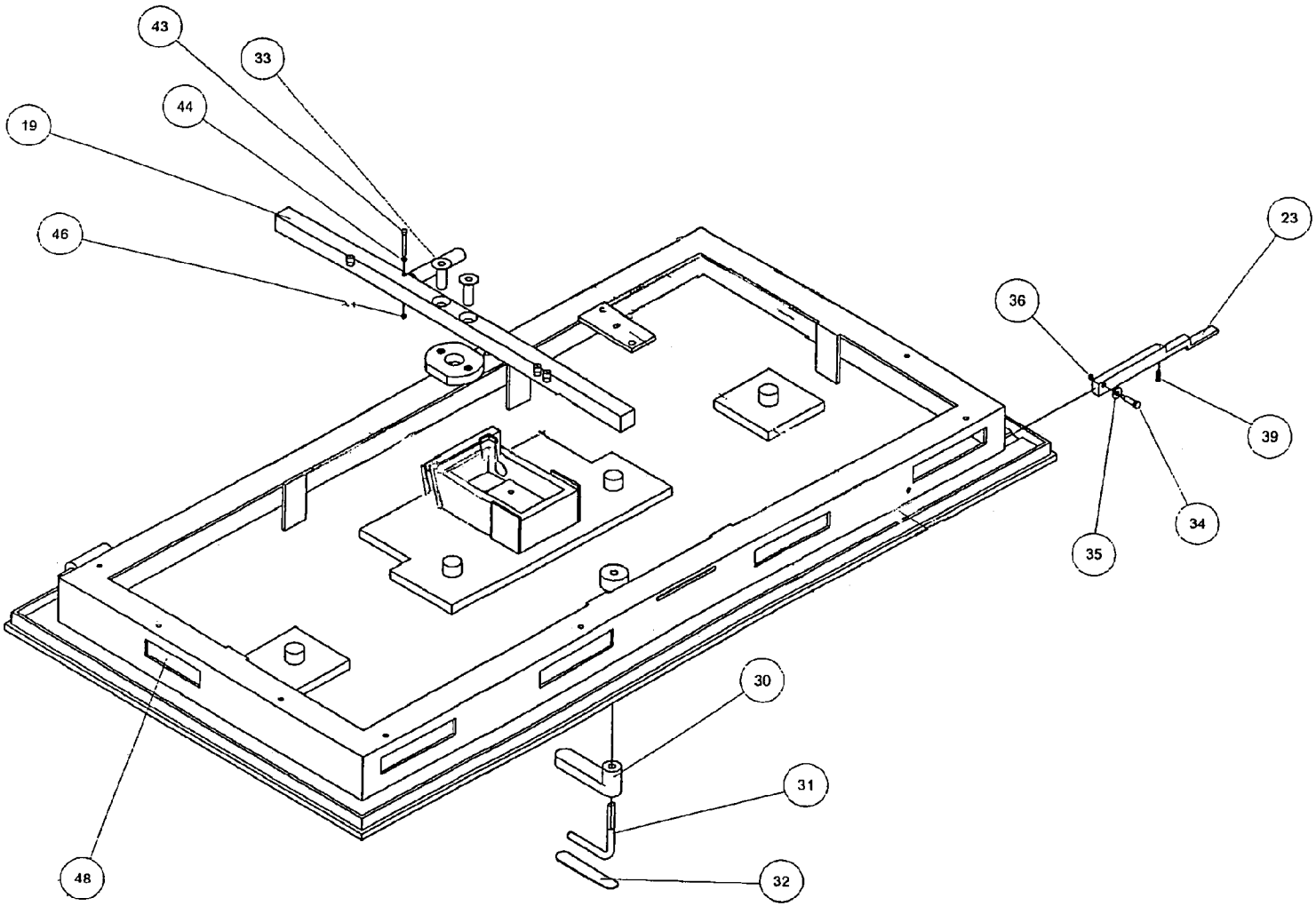
FIG. 12 illustrates a perspective view of a bolt and linkage assembly for a door having one locking bolt and one dead bolt, in accordance with the principles of the present invention.
Figure 13:
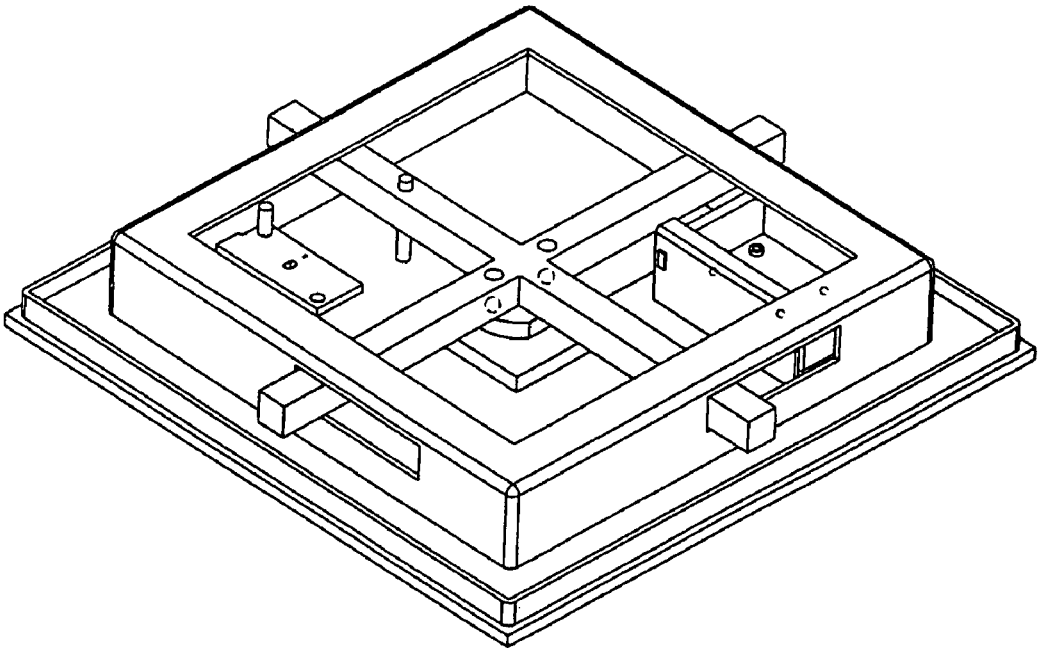
FIG. 13 is a perspective view of a door having a locking bolt with four locking bolt end portions.

FIG. 11 illustrates a detailed view of a bolt extension assembly of a lock, in accordance with the principles of the present invention.

When the lock 45 is locked, the plunger 53 extends the blocking bolt 29 into the gap between the dead bolts 22. When the blocking bolt 29 is in the locked position, the blocking bolt 29 is between the distal ends of dead bolts 22 and thereby prevents dead bolts 22 from moving forward toward each other.

When the lock 45 is unlocked, the plunger 53 retracts the blocking bolt 29 away from the gap between the dead bolts 22. When the blocking bolt 29 is in the unlocked position, the blocking bolt 29 is retracted clear of the distal ends of dead bolts 22 and therefore allows the dead bolts 22 to move toward each other.

The locking system shown in drawings includes four locking bolts 16, 17, 18, 19. However, the locking system is not limited to such a configuration. In accordance with the principles of the present invention, the locking system could have less than four locking bolts, or could have more than four locking bolts. The present invention provides high reliability with a reduced number of wear points and lower force loads leveraged from the use of the rotational movement arm activating multiple locking bolts substantially simultaneously.

Locking bolts 16, 17, 18, 19 shown in drawings are constructed from square steel bar stock having a square cross section. However, locking bolts 16, 17, 18, 19 are not limited to such a configuration. In accordance with the principles of the present invention, locking bolts 16, 17, 18, 19 can include portions having a rectangular cross section, circular cross section, or other shape.

Locking bolts 18, 19 shown in drawings are two-point locking bolts. However, locking bolts 18, 19 are not limited to being two-point locking bolts. In accordance with the principles of the present invention, one or both locking bolts 18, 19 could be one-point locking bolts, two-point locking bolts, three-point locking bolts, or four-point locking bolts. One or both locking bolts 18, 19 could have five or more points.

Locking bolts 16, 17 shown in drawings are three-point locking bolts. However, locking bolts 16, 17 are not limited to being three-point locking bolts. In accordance with the principles of the present invention, one or both locking bolts 16, 17 could be one-point locking bolts, two-point locking bolts, three-point locking bolts, or four-point locking bolts. One or both locking bolts 16, 17 could have five or more points.

Another embodiment of the present invention is as follows. In accordance with the principles of the present invention, the locking system of the present invention can be configured to have only one locking bolt and only one dead bolt 22. In this configuration, locking bolts 16, 17, and 18 would not be included. Also, the dead bolt 22 coupled to locking bolt 18 would not be included. In this configuration, lock box 1 shown in FIG. 9 would only need one hole for receiving a dead bolt 22, because there would only be one dead bolt 22. When lock 45 is locked, the plunger 53 would extend blocking bolt 29 forward toward a distal end of the one dead bolt 22. Thus, when lock 45 is locked, forward movement of the one dead bolt 22 would be blocked and prevented, and thus rotational movement of locking bolt 18 would be prevented, and thus handle 30 would not be able to rotate to the open position. In this configuration, the present invention uses a rotational movement arm to activate a single locking bolt.

While the invention has been described in conjunction with various embodiments, they are illustrative only. Accordingly, many alternative modifications and variations will be apparent to persons skilled in the art in light of the foregoing detailed description. The foregoing description illustrates some alternatives and variations falling within the spirit and broad scope of the appended claims. While the present invention has been illustrated by the description of embodiments thereof, and while the embodiments have been described in considerable detail, it is not the intention to restrict or in any way limit the scope of the appended claims to such detail.

Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit and scope of the general inventive concept.

What is claimed is:

1. A locking apparatus, comprising:

a plurality of locking bolts being movable between a locked position and an unlocked position, and being mounted to a door which covers over an access opening of an enclosure, said plurality of locking bolts including at least first and second locking bolts;

a frame assembly being provided on an interior of the door, said frame assembly forming a plurality of slotted portals respectively guiding said at least first and second locking bolts;

a plurality of door jams blocking said plurality of locking bolts to hold the door in position over the access opening when said plurality of locking bolts are in the locked position, said plurality of door jams being mounted to the enclosure;

first and second dead bolts being coupled to said first and second locking bolts respectively, said first and second dead bolts being arranged to move toward each other when said first and second locking bolts are moved from the locked position to the unlocked position;

a lock being mounted to the door; and a blocking bolt being coupled to said lock and being movable between a locked position and an unlocked position, said blocking bolt moving in dependence upon said lock, said blocking bolt being disposed between distal ends of said first and second dead bolts when said lock is locked, said blocking bolt being moved away from the distal ends of said first and second dead bolts when said lock is unlocked;

each locking bolt having a single piece construction extending across the frame assembly and having at least a first end and an opposite second end, the ends moving through an arcuate path, wherein when the locking bolts are in a locked position, each of the ends of the respective locking bolts are received in a respective one of the slotted portals formed in the frame;

wherein when said lock is locked, said blocking bolt prevents said first and second dead bolts from moving closer together, prevents said first and second locking bolts from moving from the locked position to the unlocked position, and prevents the door from being moved away from the access opening.

2. The locking apparatus of claim 1, wherein when said lock is unlocked, said blocking bolt is moved away from the distal ends of said first and second dead bolts and thus said first and second dead bolts can be moved closer together, said first and second locking bolts can be moved from the locked position to the unlocked position, and the door can be moved away from the access opening.

3. The locking apparatus of claim 1, wherein said first and second locking bolts are pivotally mounted on an interior of the door, said first dead bolt is pivotally mounted to an upper side of said first locking bolt, said second dead bolt is pivotally mounted to a lower side of said second locking bolt, with the upper side of said first locking bolt substantially facing the lower side of said second locking bolt.

4. The locking apparatus of claim 1, further comprising:

a handle being rotatably mounted on the door; and a cam being rotatably mounted on an interior of the door, coupled to said handle, and pivotally connected to said first and second locking bolts, wherein said handle is rotated to rotate said cam such that said first and second locking bolts are moved between the locked position and the unlocked position.

5. The locking apparatus of claim 4, wherein said handle is rotated through an acute angle to move said first and second locking bolts from the locked position to the unlocked position.

6. The locking apparatus of claim 1, wherein said first locking bolt is pivotally mounted on an interior of the door intermediately of the length of said first locking bolt.

7. The locking apparatus of claim 1, wherein said lock includes an electro-mechanical combination lock.

8. The locking apparatus of claim 1, wherein said first locking bolt has at least two locking bolt ends, each of the locking bolt ends being blocked by a respective one of said plurality of door jams.

9. The locking apparatus of claim 1, wherein at least one of said plurality of locking bolts has three locking bolt ends and only one pivot point, each of the locking bolt ends being blocked by a respective one of said plurality of door jams, thereby providing a three-point locking system with the one pivot point.

10. A locking assembly for an enclosure having an access opening, the locking assembly comprising:

at least a single piece construction forming multiple locking bolts mounted to a door which covers the access opening of the enclosure, each locking bolt having at least a first and an opposite second end, the ends moving through an arcuate path, wherein when the door covers the access opening and said locking bolts are in a locked position, said locking bolts are blocked by door jams mounted to the enclosure;

a frame assembly provided on an interior of the door, a plurality of slotted portals being formed in the frame;

first and second dead bolts being coupled to said locking bolts respectively, said dead bolts being arranged to move toward each other when said locking bolts are moved from the locked position to an unlocked position;

a lock being mounted to the door; and a blocking bolt being coupled to said lock and moving in dependence upon said lock, said blocking bolt being between distal ends of said first and second dead bolts when said lock is locked, said blocking bolt moving away from the distal ends of said dead bolts when said lock is unlocked, wherein when said lock is locked, said blocking bolt prevents said first and second dead bolts from moving closer together, prevents said locking bolts from moving to an unlocked position, and prevents the door from being moved away from the access opening, a handle being rotatably mounted on the door, and a cam being rotatably mounted on an interior of the door, coupled to said handle, and pivotally connected to each of said locking bolts through a linkage, wherein said handle is rotated to rotate said cam such that the ends of the locking bolts are moved, rotationally through an arcuate path between the locked position, and the unlocked position, wherein, when the locking bolts are in a locked position, the ends of the respective locking bolts are received in a respective slotted portal formed in the frame.

11. The locking assembly of claim 10, wherein when said lock is unlocked, said blocking bolt is moved away from the distal ends of said first and second dead bolts and thus said first and second dead bolts can be moved closer together, said locking bolts can be moved from the locked position to the unlocked position, and the door can be moved away from the access opening.

12. The locking assembly of claim 10, wherein said first locking bolt has at least two locking bolt ends, each of the locking bolt ends being blocked by a respective one of the door jams.

13. The locking assembly of claim 10, further comprising:

a third locking bolt being pivotally mounted to the door, said third locking bolt being linked to at least one locking bolt selected from among said first and second locking bolts such that, when said first and second locking bolts are in the locked position, said third locking bolt is also in the locked position;

wherein when the door covers the access opening and said first, second, and third locking bolts are in the locked position, said third locking bolt is blocked by one or more of the door jams;

wherein when said lock is locked, said blocking bolt prevents said first, second, and third locking bolts from moving to the unlocked position, and prevents the door from being moved away from the access opening.

14. The locking assembly of claim 13, said third locking bolt having three locking bolt ends and only one pivot point, each of the locking bolt ends being blocked by a respective one of the door jams, thereby providing a three-point locking system with the one pivot point.

15. A method of securely closing a door over an access opening of an enclosure, the method comprising:

closing the door to cover over the access opening of the enclosure;

rotating a plurality of locking bolts to a locked position such that the locking bolts are blocked by door jams, the locking bolts being mounted to the door, the locking bolts each having a single piece construction extending across the frame assembly having at least a pair of opposite ends, the door jams being mounted to the enclosure, the door jams having a plurality of slotted portals formed therein, wherein the respective ends of the locking bolts are moved through an arcuate path, being received in a respective slotted portal, each of the locking bolts being further coupled to a respective dead bolt;

when said rotating is performed, moving distal ends of the dead bolts away from each other to form a gap therebetween; and locking a lock mounted to the door; and when said locking of the lock is performed, the ends of each of the locking bolts are disposed in respective slotted portals, a blocking bolt coupled to the lock is moved into the gap to prevent the distal ends of the dead bolts from moving back toward each other;

wherein when the distal ends of the dead bolts are prevented from moving back toward each other, the locking bolts are prevented from moving and the door is held securely closed over the access opening.

16. The method of claim 15, further comprising:

when said rotating is performed, rotating an additional locking bolt such that the additional locking bolt is blocked by selected ones of the door jams, the additional locking bolt being mounted to the door and being linked to at least one locking bolt selected from among the plurality of locking bolts.

17. In a secure door for a safe, vault or other security apparatus, wherein the door has a locked and an unlocked position and further has exterior and interior portions, respectively, and wherein a manually-manipulatable lock is mounted on the exterior of the door, the improvement comprising at least one single piece construction forming multiple locking bolts pivotably mounted on the interior of the door intermediately of the length of each locking bolt, each locking bolt extending across the door, each locking bolt having at least a first end and an opposite second end, the respective ends moving in an arcuate path, a door frame provided with slotted portals in which the ends of the locking bolts are received, a pair of dead bolts disposed intermediately of the locking bolts and transversely thereof, each dead bolt having a distal end pivotably mounted to a respective locking bolt, a blocking bolt actuatable by the manually-manipulatable lock and normally engaging and preventing the pivoting of the dead bolts in the locked position of the door, such that upon the successful opening of the lock, the blocking bolt may be retracted, thereby allowing the dead bolts to be retracted, and thereby allowing the locking bolts to pivot and to be released from their respective slotted portals in the door frame.

18. The improvement of claim 17, further including a rotatable handle mounted on the door frame in juxtaposition to the manually-manipulatable lock, and a pivotable cam on the interior of the door, coupled to the handle, and pivotably connected to the locking bolts, respectively, thereby providing a mechanical advantage and facilitating the pivoting of the locking bolts to the unlocked position of the door and the subsequent opening of the door.

19. The improvement of claim 17, wherein the lock comprises a combination lock.

20. The improvement of claim 17, wherein the handle is normally in a substantially horizontal position and rotates clockwise through an acute angle to release the locking bolts prior to pulling the door open.

21. The improvement of claim 17, wherein at least one of the locking bolts has a single pivot point and further has three locking ends received in respective keepers in the door frame, thereby providing a three-point locking system with a single pivot.

22. The improvement of claim 21, wherein two of the locking ends are opposite to one another, and wherein the third locking end is intermediary of the two locking ends and in a plane substantially at right angles thereto.

23. The locking apparatus of claim 1, wherein at least one of said plurality of locking bolts has more than three locking bolt ends and only one pivot point, each of the locking bolt ends being blocked by a respective one of said plurality of door jams, thereby providing a multiple-point locking system with the one pivot point.

24. A locking mechanism for the door of a safe, the door being fitted within an opening of the safe, and the safe having respective sides, comprising at least a single piece construction forming multiple locking bolts, each locking bolt pivotally connected to the inside of the door substantially in the middle of at least each single piece construction, each locking bolt having respective ends, each end adapted to be received in respective slotted portals in a door frame wherein all of the locking bolts are substantially parallel to each other in their locking position, thereby simultaneously locking the door to the safe at all sides of the safe, respective dead bolts pivotally connected to one portion of the locking bolts between one side of the door frame and the pivot connection between the locking bolts and the door, a pivoting linkage between the locking bolts on another portion of the locking bolts between the other side of the door frame and the pivot connection between the locking bolts and the door, and manually-manipulable means externally of the door for allowing the respective dead bolts to be retracted, such that the respective locking bolts pivot and a first portion of the locking bolts are in a non-parallel position with respect to a second portion of the locking bolts, thereby constituting the unlocked position of the locking bolts and thereby allowing the door to be opened, the respective ends of each locking bolt moving through an arcuate path to move from the locking to the unlocking position and vice-versa.

* * * * *

UNITED STATES PATENT AND TRADEMARK OFFICE

CERTIFICATE OF CORRECTION

PATENT NO. : 7,387,076 B2
APPLICATION NO. : 11/242484
DATED : June 17, 2008
INVENTOR(S) : Armfield, Jr. et al.

It is certified that error appears in the above-identified patent and that said Letters Patent is hereby corrected as shown below:

On the Title page (75)
Inventors: Robert M. Bauman, Severna Park, MD (US)
Joseph T. Armfield, Jr., Westminster, MD (US)

Should read –

Inventors: Joseph T. Armfield, Jr., Westminster, MD (US)
Robert M. Bauman, Severna Park, MD (US)

Signed and Sealed this

Nineteenth Day of August, 2008

JON W. DUDAS
*Director of the United States Patent and Trademark Office*